US007550663B2

(12) United States Patent
Lin

(10) Patent No.: US 7,550,663 B2
(45) Date of Patent: Jun. 23, 2009

(54) PEDAL DEVICE WITH SHIFTABLE STEPPING POSITION FOR PERCUSSION INSTRUMENTS

(75) Inventor: Hsi Tan Lin, Daya Township, Taichung County (TW)

(73) Assignee: E-Bin Industrial Co., Ltd., Taichung County (TW)

( * ) Notice: Subject to any disclaimer, the term of this patent is extended or adjusted under 35 U.S.C. 154(b) by 0 days.

(21) Appl. No.: 11/802,095

(22) Filed: May 18, 2007

(65) Prior Publication Data

US 2008/0282868 A1 Nov. 20, 2008

(51) Int. Cl.
*G10D 13/02* (2006.01)

(52) U.S. Cl. ..... 84/422.1; 84/411 R; 84/422.3

(58) Field of Classification Search ..... 84/422.1, 84/422.2, 422.3, 104, 403, 404; D17/22, D17/24, 99

See application file for complete search history.

(56) References Cited

U.S. PATENT DOCUMENTS 3,930,431 A * 1/1976 Magadini ..... 84/422.1
3,967,523 A * 7/1976 Currier et al. ..... 84/422.1
5,192,822 A * 3/1993 Hoshino ..... 84/422.3
2004/0020345 A1* 2/2004 Matsuzoe et al. ..... 84/422.1
2004/0144198 A1* 7/2004 Gatzen ..... 74/560

* cited by examiner

*Primary Examiner*—Jeffrey Donels
*Assistant Examiner*—Christopher Uhlir
(74) *Attorney, Agent, or Firm*—Troxell Law Office, PLLC

(57) ABSTRACT

A pedal device with a shiftable stepping position for a percussion instrument is disclosed. In view of the problems in the prior art that the player feels discomfort when the angle of the footboard is not correct and that the instrument may have a worse pose, the invention provides a back bottom board under the pedal device that can rotate and adjust its side-shifting angles. By shifting the position of the back bottom board, the footboard is moved and fixed at a position preferred by the player. Therefore, the position of the footboard is adjusted according to the stepping position of the player. Therefore, the invention can avoid the player's discomfort and be disposed as desired.

6 Claims, 6 Drawing Sheets

PEDAL DEVICE WITH SHIFTABLE STEPPING POSITION FOR PERCUSSION INSTRUMENTS

BACKGROUND OF THE INVENTION

1. Field of Invention

The invention relates to a pedal device with shiftable stepping position for a percussion instrument and, in particular, to a pedal with an adjustable stepping position.

2. Related Art

FIG. 6 shows a conventional pedal device for a bass drum in the prior art. Generally speaking, the bass drum directly faces the audience in a concert. The striking direction of the drumstick 72 on the pedal 71 is roughly perpendicular to the surface of the drum. The longitudinal direction of the pedal 71 is also perpendicular to the drum surface for the player to hit the drum.

However, the player usually has to control several instruments at the same time. In particular, the positions of the bass drum, the cymbal, and the player's foot are often not ideally arranged, so that the player cannot perform well. After long-time performance, the player often feels uncomfortable because of the twisted ankle.

Moreover, to get a suitable position for the player to step on, the position of the pedal 71 has to be modified. However, the drumstick 72 would not have the original perpendicular striking direction in this case. As a result, no beautiful drum-beats can be obtained. If the position of the bass drum is also changed, many other instruments have to change their positions as well.

SUMMARY OF THE INVENTION

An objective of the invention is to solve the above-mentioned problems and provide a pedal device with a shiftable stepping position for percussion instruments. The footboard is pivotally disposed on a stepping device that can rotate and adjust its side-shifting angle. By adjusting the side-shifting position of the stepping device, the footboard can be positioned at a desired position, making the player feel more comfortable.

To achieve the above-mentioned objective, the invention includes:

a base;

a footboard, which rotates pivotally along the stepping direction and is connected to a linking element with its front end; and a set of bottom boards, including a front bottom board and a back bottom board;

wherein the base is fixed on the front bottom board and the back end of the footboard is connected to the back bottom board; the front end of the back bottom board and the front bottom board are connected using a fixing screw through them, so that the back bottom board is rotatable with respect to the fixing screw; the back bottom board is formed with an arc guiding groove whose center is the rotating center of the back bottom board; and a fixing screw goes through the arc guiding groove to connect to the front bottom board for fixing the distance between the back bottom board and the front bottom board.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

Figure 1:
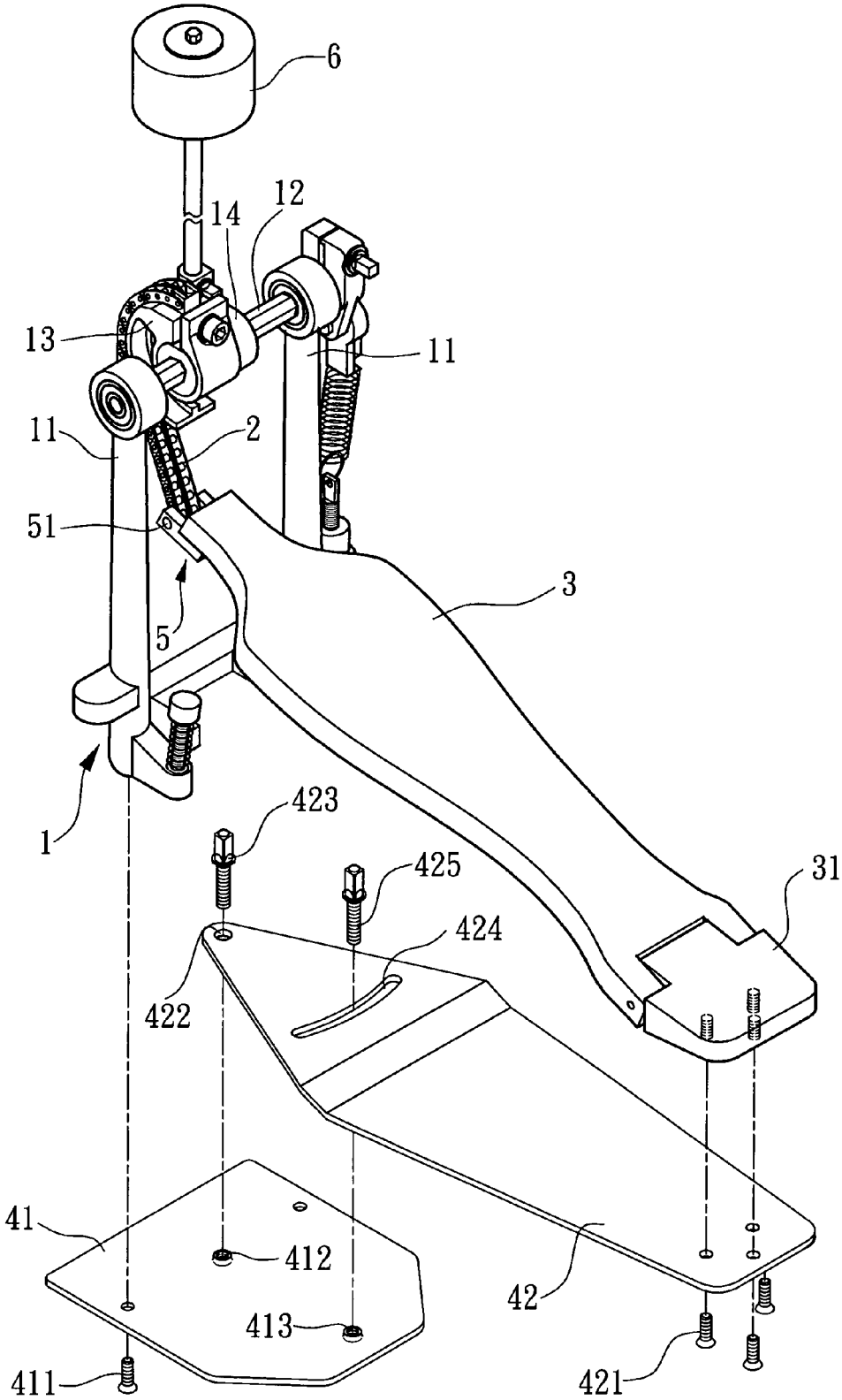
FIG. 1 is a three-dimensional view of the invention before assembly.
Figure 2:
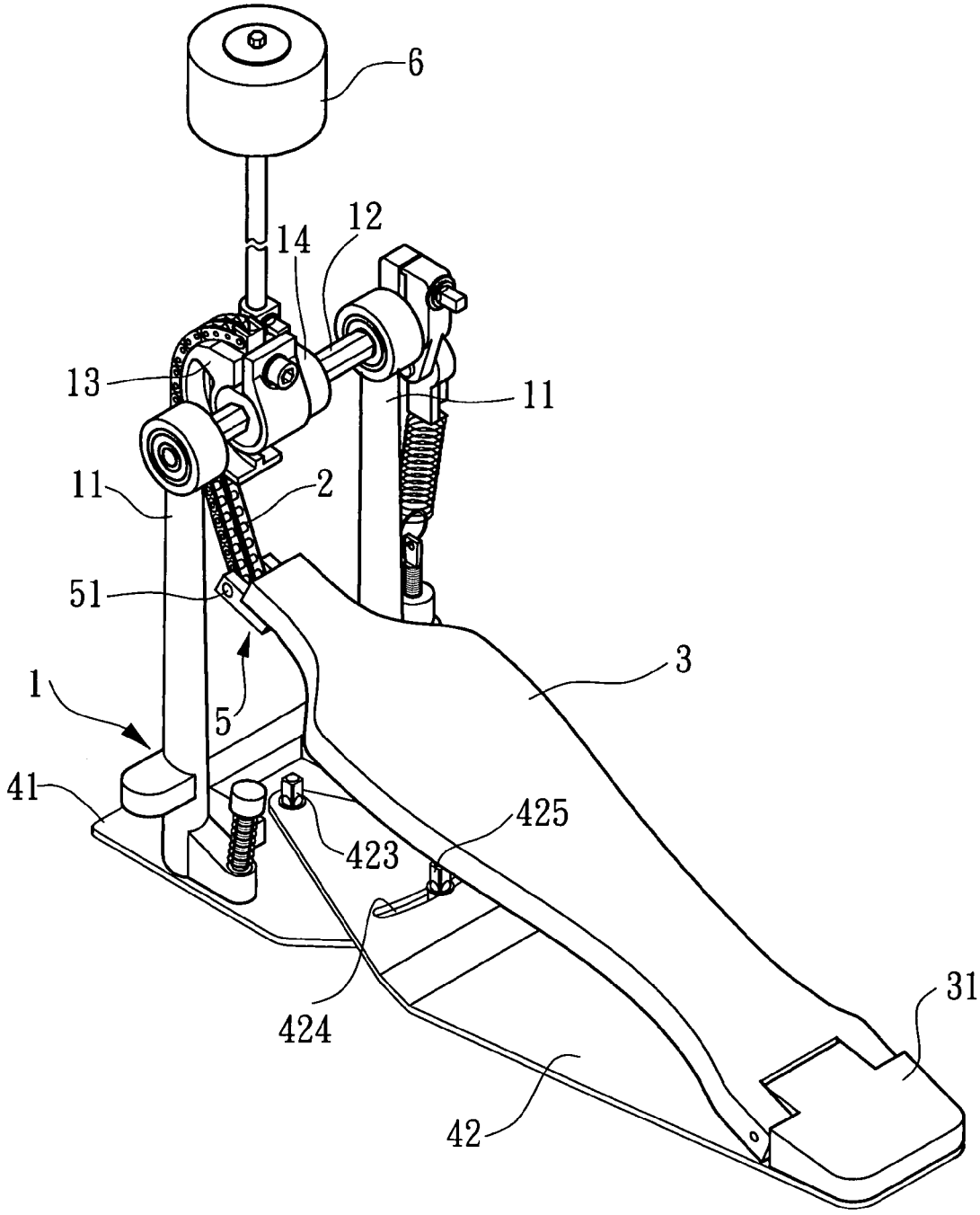
FIG. 2 is a three-dimensional view of the invention after assembly.

The present invention will be apparent from the following detailed description, which proceeds with reference to the accompanying drawings, wherein the same references relate to the same elements.

A preferred embodiment of the invention is shown in FIGS. 1 to 5. However, the invention is not limited to this example.

This embodiment uses a pedal device for the bass drum as an example. The pedal device includes: a base 1 and a footboard 3.

The footboard 3 can pivotally rotate toward the stepping direction. It is connected to the front end of the footboard 3 via a linking element 2.

In this embodiment, the base 1 has two vertical posts 11. An axle 12 stride across the upper ends of the posts 11. The axle 12 is connected with a cam element 13 and a drumstick fixing part 14. It is connected to the outer edge of the cam element 13 using one end of the linking element 2 (a chain here or a rubber belt in other embodiments). The other end of the linking element 2 is connected with the front end of the foot board 3. The rear end of the footboard 3 is pivotally installed with a heel pedal 31, which is fixed on the back bottom board 42. Therefore, the footboard 3 can rotate along the stepping direction.

Besides, the pedal device is provided with a set of bottom boards, including a front bottom board 41 and a back bottom board 42. The rear end of the footboard 3 is connected to the rear end of the back bottom board 42. The base 1 is fixed on the front bottom board 41 using several screws 411. The heel pedal 31 is fixed on the back bottom board 42 using several screws 421.

A fixing screw 423 goes through the front end of the back bottom board 42 and the front bottom board 41. In this embodiment, the front end of the back bottom board 42 has a through hole 422. The fixing screw 423 goes through the through hole 422 and combines with a screw hole 412 on the front bottom board 41. Therefore, the back bottom board 42 can rotate with respect to the fixing screw 423.

The back bottom board 42 is formed with an arc guiding groove 424 whose arc center is the rotating center of the back bottom board 42. A screw hole 413 is formed on the front bottom board 41 below the arc guiding groove 424. A fixing screw 425 goes through the arc guiding groove 424 and locks into the screw hole 412 on the front bottom board 41. This fixes the relative position between the back bottom board 2 and the front bottom board 1.

The lower edge of the front end of the footboard 3 combines with a linking component 5. A pin 51 connects the lower edge of the linking element 2 (chain) to the linking component 5. The linking component 5 includes a through hole 52 for inserting a screw pin 53. The lower edge of the front end of the footboard 3 is formed with a screw hole 32 for the screw pin 53 to lock into. This fixes the linking component 5 to the front end of the footboard 4.

Figure 3:
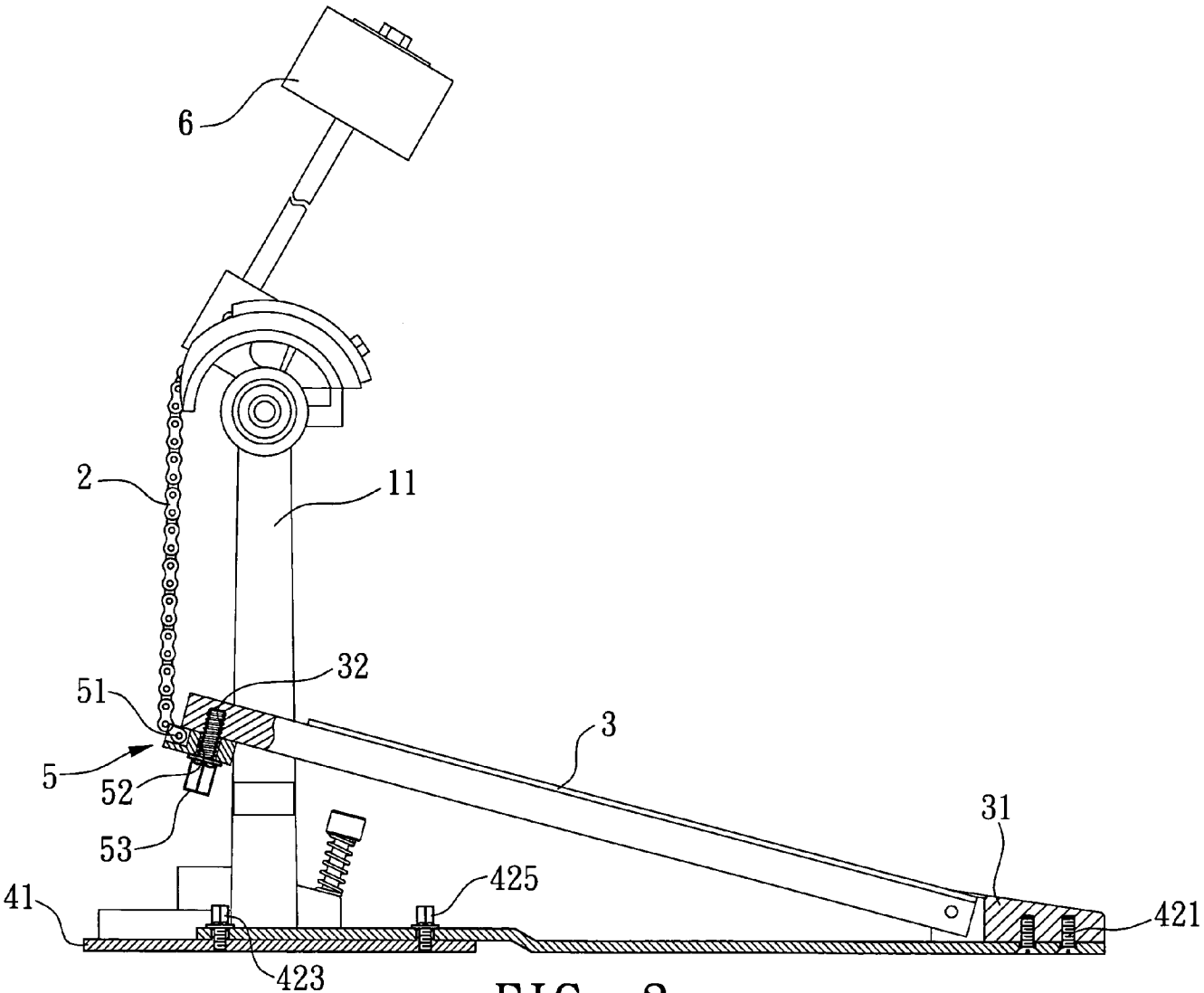
FIG. 3 is a side view of the invention in FIG. 2.
Figure 4:
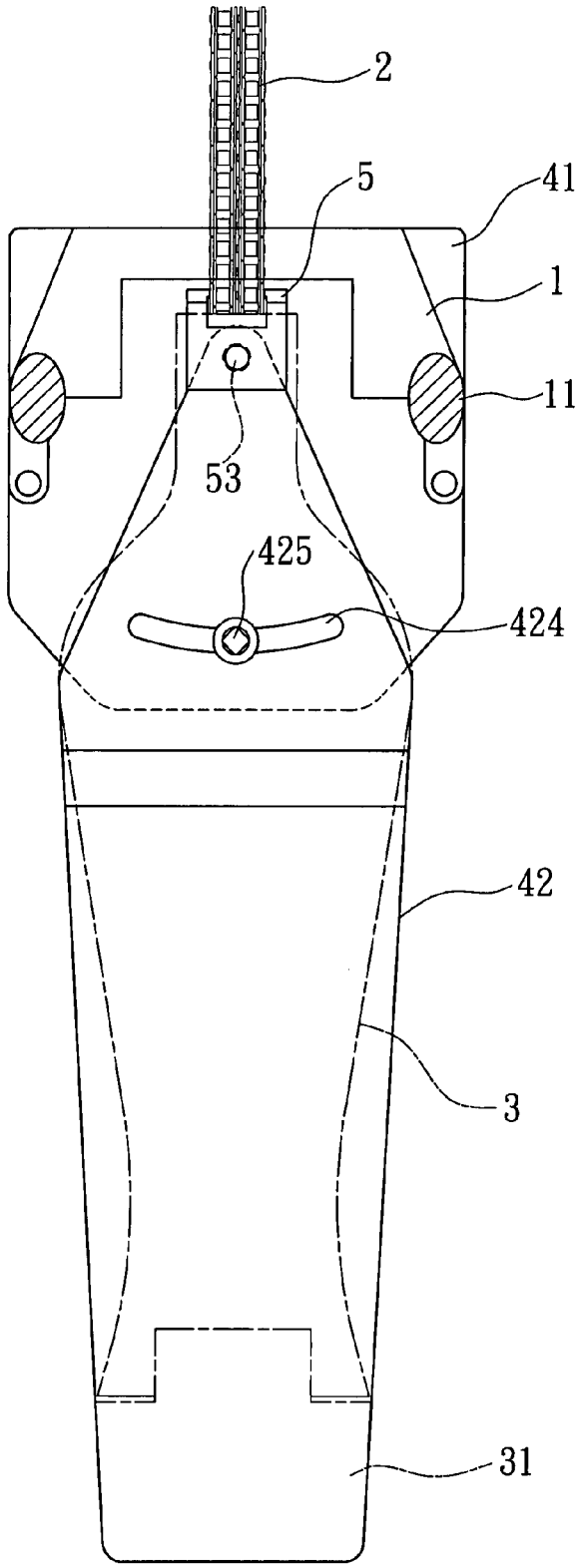
FIG. 4 is a top view of the pedal device of a percussion instrument in its normal position.
Figure 5:
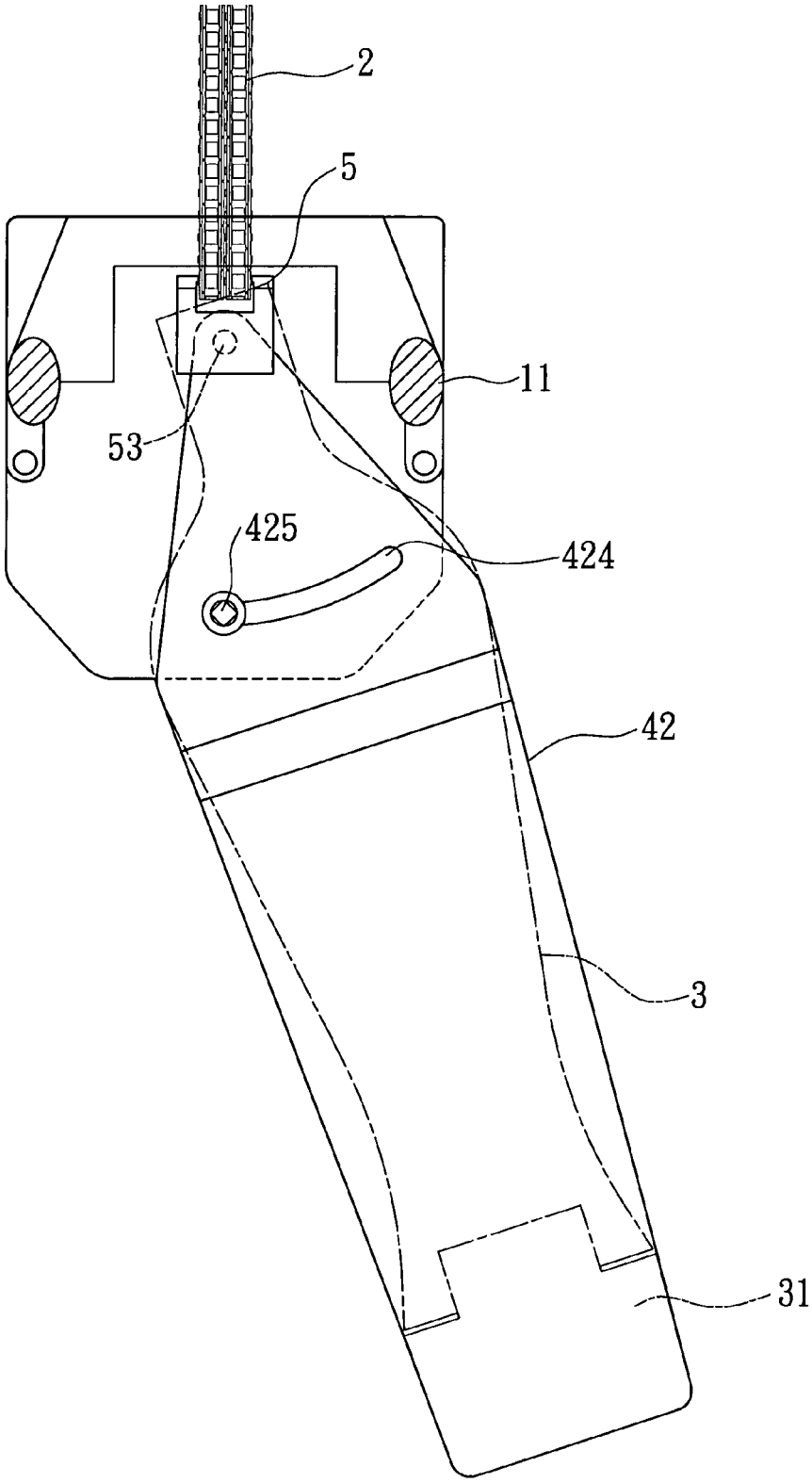
FIG. 5 is a top view of the pedal device of a percussion instrument shifted to the right.
Figure 6:
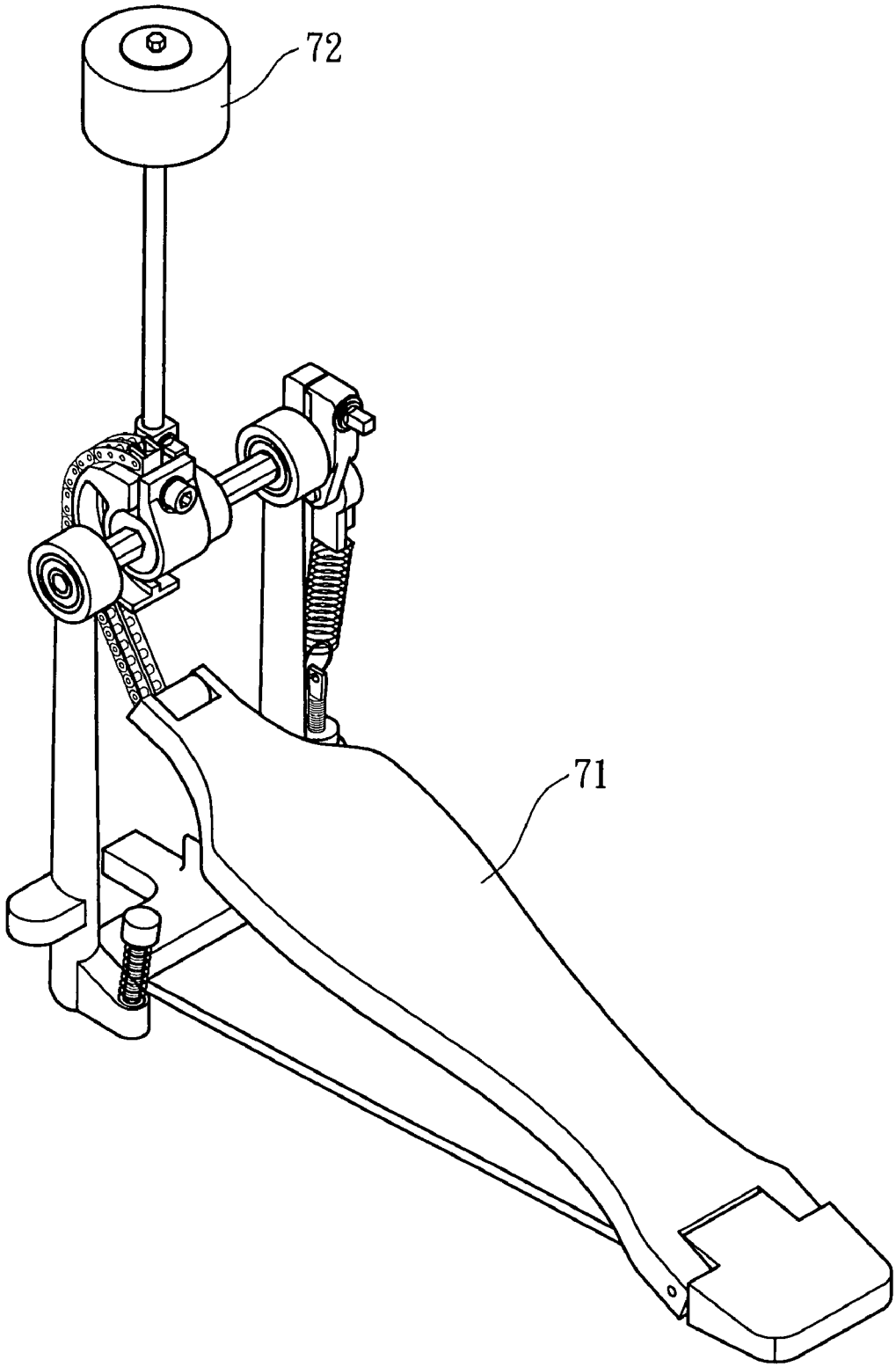
FIG. 6 PRIOR ART
FIG. 6 is a three-dimensional view of the conventional pedal device for a percussion instrument that does not have the shifting function.

With reference to FIGS. 3 to 5, the back bottom board 42 can rotate with respect to the fixing screw 423 when it is loose. Therefore, the footboard 3 can be adjusted to a positioned preferred by the player. The fixing screw 425 is then fastened so that the back bottom board 42 is firmly fixed on the front bottom board 41.

Secondly, after the footboard 3 is adjusted to the player's preferred position, the side-shifting range of the back bottom board 42 is limited due to the constraint on the arc guiding groove 424 by the fixing screw 425.

After the footboard 3 is shifted, the player can loosen the screw pin 53 for the linking component 5 to rotate on both sides. Therefore, the chain 2 can still make the drumstick 6 action even after the footboard 3 has changed its position.

In summary, the player can adjust the footboard position of the invention. In addition to removing discomfort of the user, the percussion instrument can be disposed at the user's will.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A pedal device with a shiftable stepping position for a percussion instrument, comprising:

a base;

a footboard, which rotates along the stepping direction and whose front end is connected with a linking element;

a set of bottom boards, including a front bottom board and a back bottom board;

wherein the base is fixed on the front bottom board and the back end of the footboard is connected to the back bottom board;

the front end of the back bottom board and the front bottom board are connected using a fixing screw through them, so that the back bottom board is rotatable with respect to the fixing screw;

the back bottom board is formed with an arc guiding groove whose center is the rotating center of the back bottom board; and a fixing screw goes through the arc guiding groove to connect to the front bottom board for fixing the distance between the back bottom board and the front bottom boards, wherein a length of the arc guiding groove is less than a width of a section of the footboard directly overlying the arc guiding groove.

2. The pedal device with a shiftable stepping position for a percussion instrument of claim 1, wherein the front end of the back bottom board has a through hole and the fixing screw goes through the through hole and connects to a screw hole on the front bottom board.

3. The pedal device with a shiftable stepping position for a percussion instrument of claim 1, wherein a screw hole is formed on the front bottom board under the arc guiding groove and the fixing screw goes through the arc guiding groove and locks into the screw hole.

4. The pedal device with a shiftable stepping position for a percussion instrument of claim 1, wherein the lower edge at the front end of the footboard is connected with a linking component, a pin goes through the lower end of the linking element to the linking component, the linking component includes a through hole for inserting a screw pin, the lower edge at the front end of the footboard is formed with a screw hole for the screw pin to lock into, thereby fixing the linking component to the front end of the footboard.

5. The pedal device with a shiftable stepping position for a percussion instrument of claim 1, wherein the base has two vertical posts, an axle having a cam element and a drumstick fixing part strides across the upper ends of the posts, one end of the linking element connects to the outer edge of the cam element, the other end of the linking element connects to the front end of the footboard, the rear end of the footboard is pivotally installed with a heel pedal, and the heel pedal is fixed on the back bottom board.

6. The pedal device with a shiftable stepping position for a percussion instrument of claim 5, wherein the base is fixed on the front bottom board using several screws and the heel pedal is fixed on the back bottom board using several screws.

* * * * *